US005490405A

United States Patent [19]

Rämö et al.

[11] Patent Number: 5,490,405

[45] Date of Patent: Feb. 13, 1996

[54] CYLINDER LOCK—KEY—COMBINATION

[75] Inventors: Seija Rämö; Kyösti Nevalainen, both of Joensuu; Pekka Vehviläinen, Liperi, all of Finland

[73] Assignee: Abloy Security Ltd Oy, Helsinki, Finland

[21] Appl. No.: 201,659

[22] Filed: Feb. 25, 1994

[30] Foreign Application Priority Data

Mar. 25, 1993 [FI] Finland ..... 931340

[51] Int. Cl.[6] ..... E05B 29/02

[52] U.S. Cl. ..... 70/366; 70/406; 70/409; 70/392

[58] Field of Search ..... 70/366, 365, 490, 70/367, 369, 377, 392, 393, 406, 409, 389

[56] References Cited

U.S. PATENT DOCUMENTS

| | | | |
|---|---|---|---|
| 2,217,047 | 10/1940 | Fitz Gerald | 70/366 |
| 3,789,638 | 2/1974 | Robert et al. | 70/366 |
| 4,127,996 | 12/1978 | Malminen et al. | 70/365 |
| 4,320,639 | 3/1982 | Kleefeldt et al. | 70/377 |
| 4,686,843 | 8/1987 | Martikainen et al. | 70/366 |
| 5,131,248 | 7/1992 | Ho . | |

FOREIGN PATENT DOCUMENTS 3526173 1/1987 Germany .

*Primary Examiner*—Darnell M. Boucher
*Attorney, Agent, or Firm*—Smith-Hill and Bedell

[57] ABSTRACT

A disc cylinder lock mechanism comprises a cylinder housing, an inner cylinder turnable inside the cylinder housing, and a stack of discs inside the inner cylinder. The discs define respective key openings which form a key channel for receiving a key. The stack of discs includes several locking discs, and the lock mechanism is in a releasing condition when each locking disc is in a predetermined releasing angular position. Each locking disc has a protrusion that extends toward the central part of the key opening and has first and second adjacent and substantially perpendicular edges. A guiding element extends longitudinally over the stack of discs in the key channel. The key has a combination surface for each locking disc and is formed to engage the guiding element when the key is inserted in the key channel for turning the guiding element continuously with the key when the key is turned in the lock. When the key is inserted in the key channel and is turned in one direction, the combination surfaces engage the first edges of the respective locking discs to bring each locking disc to its respective predetermined angular releasing position, and when the key is turned in the opposite direction the guiding element engages the second edges of the respective locking discs to bring each locking disc to a key removal position.

22 Claims, 2 Drawing Sheets

Figure 1:
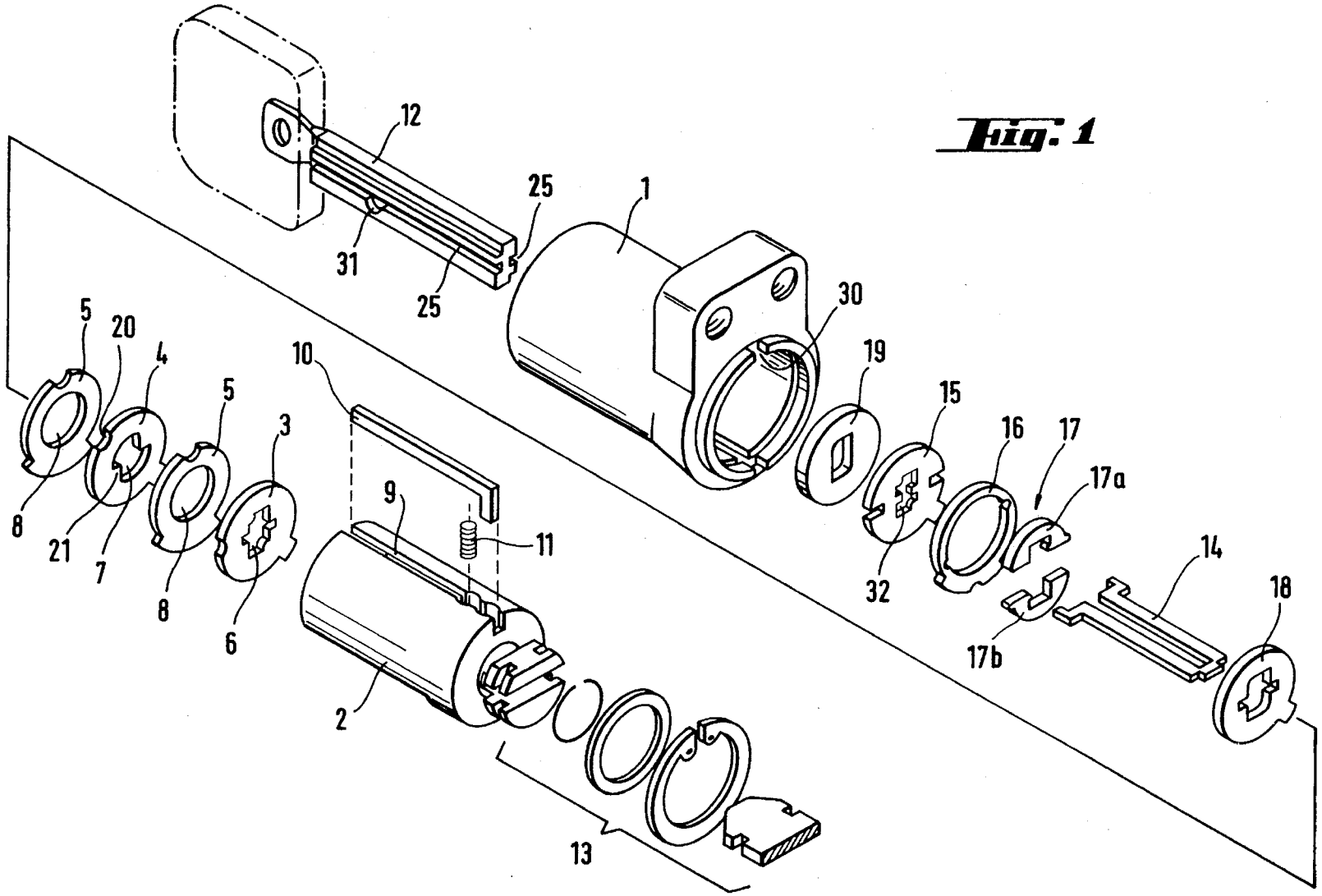

Fig. 2
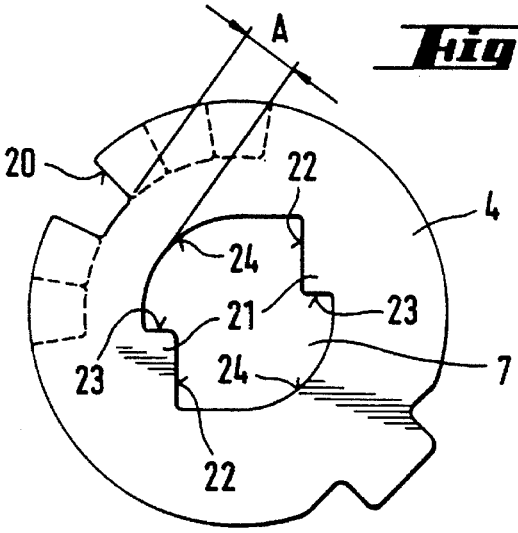
Fig. 5
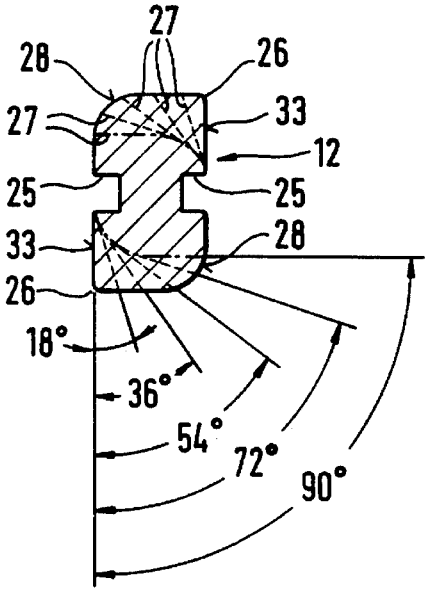
Fig. 3
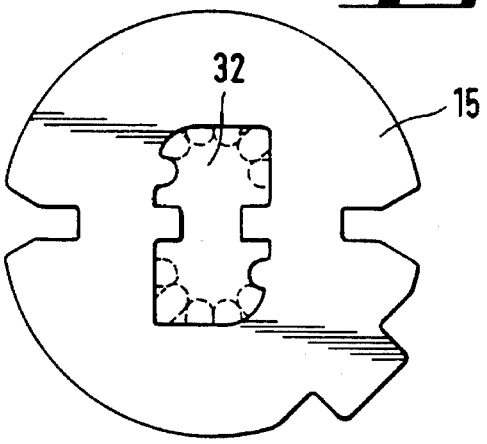
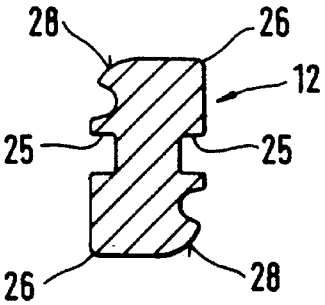
Fig. 6a
Fig. 4
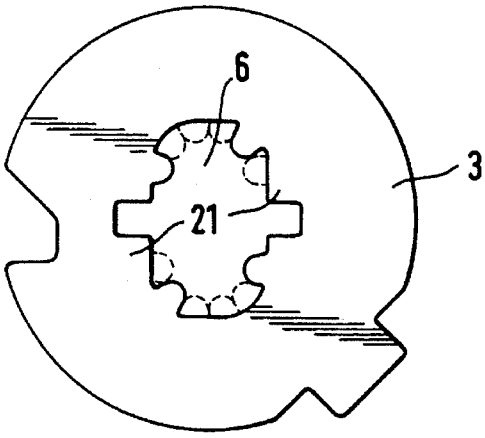
Fig. 6b
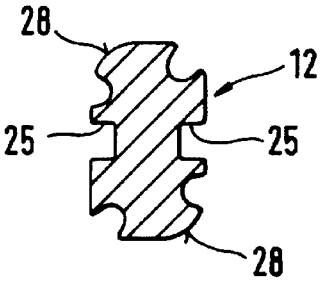

CYLINDER LOCK— KEY— COMBINATION

The invention relates to a cylinder lock-key-combination in accordance with the preamble of claims and to a key or a key blank provided therefore.

A cylinder lock of the kind, provided with turnable locking discs, has been known as such already for a long time. Even if the number of different opening combinations available in this lock type is noticeably great, there has been a need to create further different opening variations so as to avoid coincidences, i.e. a key opens by chance a lock it is not supposed to, which is very rare as such, but especially to be able to provide lock groups for separate clients including a great number of locks and keys possibly arranged hierarchically as mastered locking systems.

One solution is to increase the number of the locking discs in the lock. The result, however, is that the lock needs more space in the axial direction thereof and, thus, is in practice no longer applicable to doors or the like objects of normal thickness. Therefore, a more advantageous alternative is to provide different new key profiles, which are at least partly but preferably entirely mutually incompatible. A known solution for providing new key profiles is disclosed in the patent publication FI 68290, corresponding to U.S. Pat. No. 4,127,996. Conventionally this lock type has been operated by a key the basic profile of which is semicircular in the cross-sectional plane of the shaft. Therefore and due to manufacturing techniques the possibilities to provide new mutually incompatible profile variations are in practice, however, rather limited. As the semicircular basic profile in question has further been in general use for a long time, the key security relating thereto or to key profiles derived therefrom forms a risk factor, because by making required additional grooves to the key profiles of the keys already in use, they can be made compatible or operable also with locks intended for only the new key profiles.

A further profile utilized in the lock type in question has a somewhat rectangular cross-section. This version, however, relates to a specific bidirectionally operable cylinder lock provided with turnable locking discs, cf. for instance the patent publication FI 74320, corresponding to U.S. Pat. No. 4,351,172. In this arrangement returning of the locking discs takes place by means of one or more return bars movable at the periphery thereof and to which force transmission from the key is accomplished through a so called lifting 0-locking disc. Relating further to this lock version the patent publication FI 81429, corresponding to U.S. Pat. No. 4,686,843, discloses a separate guiding element to be inserted in the key channel, the purpose of which is together with rotation limiting means to prevent inadvertent scrambling of the stack of locking discs by guiding displacement of the key into the lock and out from the lock so that it can take place only in a certain turning position. A further purpose for the guiding element is to impede picking of the lock. In addition by variating the form of the guiding element new key profiles can be accomplished. In this solution the guiding element, however, does not at all act directly on the locking discs themselves.

The publication WO 89/11014 discloses further a solution based on the conventional semicircular key profile and in which the combination surfaces as well as the return surfaces providing returning of the locking discs are located conventionally on the plane side of the key shaft. In addition this arrangement includes two bars fixed to the lifting 0-locking disc, of which one is located in the key channel itself. These bars together return the locking discs when the key is turned back towards the locked position of the lock mechanism. The purpose of also this arrangement is to prevent picking of the lock by preventing probing and displacement of individual locking discs by means of a picklock. Otherwise returning of the locking discs takes place in normal use of the lock mechanism by means of the key in a quite conventional way.

An aim of the invention is to provide new profile variations for the basic lock type referred above, operable in one direction and provided with turnable locking discs, by means of a new solution, in which a Guiding element known as such and to be located in the key channel is made use of so that the advantages of the previous solutions are achieved but the disadvantages thereof are eliminated. At the same time an aim is to provide such new key profiles, by means of which key security pertaining to this lock type can be improved.

The aims of the invention are achieved in a way disclosed more clearly in the claims. In accordance with the invention the stack of discs includes a number of locking discs, the key opening of which is so formed that it comprises at least one step extending towards the central part of the key opening and the adjacent sides of which being substantially perpendicular with regard to each other, whereby one side of the step forms a combination surface arranged to cooperate with a corresponding combination surface in the key for determining the turning movement of the locking disc with regard to the inner cylinder when the key is turned in the opening direction of the lock mechanism, and the other side of the step respectively forms a return surface for the locking disc on which the key is arranged to act by means of the guiding element for returning the locking disc into a locking position of the lock mechanism corresponding to the initial inserting position of the key. Thus, by utilizing a new kind of combination of the key opening of a locking disc, and of the key profile and returning of the locking discs by means of a guiding element located in the key channel, a new basic profile and new surfaces therein can be made available for providing profile variation.

The extent of the return surface in a locking disc need not be as large as that of a combination surface. Therefore in practice it is sufficient that the length of the return surface in the key opening of the locking disc is only below a third of the combination surface of the locking disc. Hereby more space is obtained in the key shaft for such surfaces that can be availed of for profile variation.

The key opening of a locking disc is with advantage designed so that it includes a curved surface extending from one end of the return surface and arranged at the position of the region for the possible cuttings for the peripheral notches in the locking disc, said curved surface being formed and positioned so that the distance between a cut peripheral notch and the key opening is preferably at least 1 mm. Hereby it is secured that the region between the peripheral notches and the key opening remains sufficiently wide in view of manufacturing and strength of the locking disc.

The guiding element preferably comprises two members extending symmetrically on both sides of the key channel in the axial direction thereof, whereby the key opening of the locking disc comprises, correspondingly, two separate steps each including a return surface arranged to cooperate with either one of the axial members of the guiding element. Hereby, for its part, it is secured that the key can be inserted in the key channel in two separate positions with 180° turning angle with regard to each other.

In practice an advantageous embodiment is achieved so that a profile disc turnable with the key of the lock and limiting the key channel is arranged between the cylinder housing and the inner cylinder at the insertion end of the key, whereby said guiding element is supported to said profile disc. The key opening of the profile disc can then be systematically variated for provision of different lock-key-families based on different key profiles.

In order to increase profile variations and for providing an improved support for said guiding element it is supported to a 0-locking disc, known per se, arranged along the key channel at the inner part of the inner cylinder, whereby the key opening of said 0-locking disc can be variated independent on said profile disc for further defining key profiles conforming to and operable in the lock.

A key or a key blank included in the combination according to the invention is with advantage formed so that the shaft part thereof has at least substantially rectangular cross-section and comprises at least one groove, preferably two grooves located symmetrically on either side of the shaft, extending lengthwise over the shaft for said guiding element. The shaft part of the key or of the key blank comprises further an edge and in association therewith a side plane, starting from which the combination surfaces determining the opening combination of the lock in each case are arranged to be cut as bevelled surfaces to be arranged at selected intervals from each other towards another edge in the shaft part located adjacent to the said first edge, said second edge being essentially rounded. Hereby the compatibility of the key with the lock is secured and at the same time it is possible to prevent the use of keys with somewhat similar profiles in the lock in question, which improves key security.

In addition the key comprises with advantage two series of combination surfaces located symmetrically on opposite sides of the center axis of the shaft part of the key, whereby the edges of the shaft part of the key located adjacent to said series of combination surfaces are rounded. Hereby the key can be inserted in the lock in two different turning positions as described above and the lock be turned open from either of these positions, which is convenient for the user. If then the key includes only one series of combination surfaces, more possibilities are achieved for profile variations but at the expense of said convenience.

The invention will now be further described, by way of example, with reference to the accompanying drawings, in which FIG. 1 shows an exploded view of an embodiment of a cylinder lock-key-combination according to the invention, FIG. 2 shows a normal locking disc included in the combination of FIG. 1, FIG. 3 shows a profile disc to be utilized in a lock for the combination according to the invention, and in addition some possible profile variation arrangements are illustrated by dotted lines, FIG. 4 shows a so called lifting 0-locking disc to be utilized in a lock for the combination according to the invention, and in addition some possible profile variation arrangements are illustrated by dotted lines, FIG. 5 shows a cross-sectional view of the basic profile of a key included in the combination according to the invention including also the possible combination cuts, FIG. 6*a* shows a cross-sectional view of the profile of the key at the position of the profile disc according to FIG. 3 included in the lock, and FIG. 6*b* shows respectively a cross-sectional view of the profile of the key at the position of the lifting 0-locking disc according to FIG. 4 included in the lock.

In the drawings 1 indicates a cylinder housing having a turnable inner cylinder 2 inside thereof. The inner cylinder 2 encloses a stack of discs, which includes a number of normal locking discs 4 turnable with a key 12 of the lock and having a key opening 7 and a peripheral notch 20 determining the opening combination of the lock mechanism, and at least one lifting 0-locking disc 3 having a key opening 6. The locking discs are separated from each other by means of intermediate discs 5 having a key opening 8. The lock mechanism includes also a locking bar 10, which in the locked position of the lock mechanism is located partly in a groove 30 in the cylinder housing 1 and partly in a slot 9 in the inner cylinder preventing turning of the inner cylinder 2 with regard to the cylinder housing 1. The locking discs can be turned with the key 12 of the lock into a position, in which the peripheral notches 20 form at the position of the slot 9 of the inner cylinder 2 in the axial direction of the lock a uniform channel, into which the locking bar 10 enters from the groove 30 in the cylinder housing 1 thereby releasing the inner cylinder 2 to turn together with the key with regard to the cylinder housing 1. This turning movement of the inner cylinder 2 is transmitted further to some desired member, for instance to a lock bolt. In FIG. 1, 13 indicates generally means, with which the inner cylinder 2 with its stack of discs is axially locked to the cylinder housing 1 and by means of which force transmission from the inner cylinder 2 can take place.

As is generally know in this lock type the lock mechanism operates under positive guidance, whereby the lifting 0-locking disc is arranged to press the locking bar 10 back into the groove 30 in the cylinder housing 1 when the lock mechanism is locked. In this connection a spring 11 is used for assisting said movement of the locking bar 10 and thus for making the operation smoother.

The lock includes also a guiding element 14 located in the key channel formed jointly by the key openings 6, 7 and 8 in the discs of the stack of discs. In the embodiment of FIG. 1 the guiding element 14 comprises two members extending axially on both sides of the key channel over the stack of discs and being connected together at the inner end of the key channel. The shaft of the key 12, respectively, has grooves 25 for the guiding element 14. In the case of FIG. 1 the guiding element 14 is supported at the inner end of the inner cylinder 2 to the lifting 0-locking disc 3 and at the outer end thereof, respectively, to the profile disc 15. The both discs 3 and 15 turn continuously with the key when the key is turned in the lock, whereby returning of the locking discs is carried out unconventionally by means of the groove 25 of the key, the discs 3 and 15 and the guiding element 14 so that the guiding element 14 acts on a counter surface 23 made in the key opening 7 of the locking discs 4 (cf. FIG. 2).

The lock of FIG. 1 includes also a drill resisting member 19 and limiting members 16 and 17 which are advantageous from the viewpoint of undisturbed operation of the lock by allowing insertion of the key 12 into the lock and removal thereof only in a certain position. Thus, they prevent inadvertent scrambling of the stack of discs, and together with the guiding element 14 they prevent wear of the lock caused especially by insertion and removal movements of the key when the lock is operated. In practice said limitation can be arranged through different means. In this case limiting plates 17*a* and 17*b* are supported to a sleeve 16, which is stationarily supported to the inner cylinder 2. When the key is turned in the lock limiting plates 17*a* and 17*b* move radially towards the shaft of the key 12 and by means of recesses 31 made, therein prevent removal of the key from the lock until the key is turned back to its initial position corresponding to the insertion position. A plate 18 supports the limiting members 16 and 17 from inside of the lock.

FIG. 2 shows a normal locking disc 4 included in the lock. The key opening 7 of the locking disc 4 has two symmetrically arranged steps or protrusions 21, which include combination surfaces which cooperate with combination surfaces 27 to be cut in the key (cf. FIG. 5), and return surfaces 23, which, when the key is returned to the initial position after unlocking the lock mechanism, under the influence of the guiding element 14 cause turning of the locking discs 4 back to their initial position corresponding to the locked position of the lock mechanism as described above. The key opening 7 has also a curved surface 24, which is formed so that the distance A between the key opening 7 and the peripheral notches 20 is sufficient in view of manufacturing techniques and strength requirements, i.e. the distance A is preferably at least 1 mm.

FIG. 3 shows a profile disc 15 to be utilized in the lock according to the invention and a key opening 32 of which is made use of to provide desired profile variations in the key shaft, which is shown with dotted lines in FIG. 3. Thus, long profile grooves extending over the whole shaft of the key are accomplished to the key shaft through the profile disc 15. In addition also short grooves can be arranged to the key shaft by making use of also the key opening 6 of the lifting 0-locking disc in a way known as such, as is shown in FIG. 4 respectively. The key profiles corresponding to the profile disc 15 according to FIG. 3 and to the 0-locking disc according to FIG. 4 are shown in FIGS. 6*a* and 6*b*.

In the embodiment of FIG. 1 the lifting 0-locking disc 4 is the innermost disc in the stack of discs in the inner cylinder 2. This is not necessary from the viewpoint of the operation of the lock mechanism, but when desired the lifting 0-locking disc can be moved outward in the stack of discs and, thus, longer profile grooves can be provided to the key shaft for provision of further profile variations. Naturally also the form and size of the grooves can be varied according to need.

As especially apparent from FIG. 5 the key is with advantage provided with two series of combination surfaces 27, the cutting of which is started from a rather acute edge 26 and a side 33 in association therewith so as to secure a sufficient effective surface for the combination surface. The adjacent edges 28 for the edges 26 are rounded by taking account of the requirements for the design of the key opening 7 as referred above. At the same time it should be observed that the combination surface 27 to be cut in the key shaft can be made sufficiently long so as to secure a reliable operation of the lock mechanism.

The invention is not limited to the embodiments shown, but several modifications are feasible within the scope of the attached claims.

We claim:

1. Disc cylinder lock-key-combination, comprising a cylinder housing (1) and inside thereof, a turnable inner cylinder (2) enclosing a stack of discs including a number of locking discs (3,4) provided with peripheral notches (20), a locking bar (10), which in its locking position together with the locking discs (3,4) prevents turning of the inner cylinder (2) with regard to the cylinder housing (1), whereby the locking discs (3,4) are turnable by means of the key (12) of the lock into a releasing position of the lock mechanism, and a guiding element (14) in a key channel formed jointly by key openings (6,7) of the discs (3,4) included in the stack of discs, extending longitudinally over the stack of discs and arranged to turn continuously with the key (12) when the key is turned in the lock, the improvement being therein that the stack of discs includes a number of locking discs (3,4), the key opening (6,7) of which is so formed that it comprises at least one protrusion (21) extending towards the central part of the key opening (6,7) and the adjacent sides of which being substantially perpendicular with regard to each other, whereby one side of the protrusion (21) forms a combination surface (22) arranged to cooperate with a corresponding combination surface (27) in the key (12) for determining the turning movement of the locking disc (3,4) with regard to the inner cylinder (2) when the key (12) is turned in the opening direction of the lock mechanism, and the other side of the protrusion (21) respectively forms a return surface (23) for the locking disc (3,4) on which the key (12) is arranged to act by means of the guiding element (14) for returning the locking disc (3,4) into a locking position of the lock mechanism corresponding to the initial inserting position of the key (12).

2. A combination according to claim 1, wherein the return surface (23) in the key opening of the locking disc is essentially shorter than the combination surface (22) of the locking disc.

3. A combination according to claim 1, wherein the key opening (7) of the locking disc (4) includes a curved surface (24) extending from one end of the return surface (23) at least as far as the angular position of the peripheral notch (20) in the locking disc (4).

4. A combination according to claim 1, wherein said guiding element (14) comprises two members extending symmetrically on both sides of the key channel in the axial direction thereof and the key opening (6,7) of the locking disc comprises, correspondingly, two separate protrusions (21) each including a return surface (23) arranged to cooperate with either one of the axial members of the guiding element (14).

5. A combination according to claim 1, wherein a profile disc (15) turnable with the key (12) of the lock and limiting the key channel is arranged between the cylinder housing (1) and the inner cylinder (2) at the insertion end of the key, said guiding element (14) being supported to said profile disc (15), and the key opening (32) of the profile disc (15) is arranged to be systematically variated for provision of different lock-key-families based on different key profiles.

6. A combination according to claim 5, wherein said guiding element (14) is supported to a 0-locking disc (3) arranged along the key channel at the inner part of the inner cylinder (2) and the key opening (6) of said 0-locking disc (3) is arranged to be variated independent on said profile disc (15) for further defining key profiles conforming to the lock.

7. A key or key blank for a combination according to claim 1, the shaft part thereof (12) having at least substantially rectangular cross-section and comprising at least one groove (25) extending lengthwise over the shaft for said guiding element (14), the shaft part thereof (12) further comprising an edge (26) and in association therewith a side plane (33), starting from which the combination surfaces (27) determining the opening combination of the lock in each case being arranged to be cut as bevelled surfaces to be arranged at selected intervals from each other towards another edge (28) in the shaft part located adjacent to the said first edge (26), said second edge (28) being essentially rounded.

8. A key or key blank according to claim 7, comprising two series of combination surfaces (27) located symmetrically on opposite sides of the center axis of the shaft part of the key (12), the edges (28) of the shaft part of the key (12) located adjacent to said series of combination surfaces (27) being rounded.

9. A key or key blank according to claim 7, wherein the shaft part thereof comprises two grooves (25) located symmetrically on either side of the shaft.

10. A combination according to claim 1, wherein the peripheral notches (20) in the locking discs (4) are within a predetermined angular range, and the key opening (7) of each locking disc (4) includes a curved surface (24) extending from one end of the return surface (23) over said predetermined angular range.

11. A combination according to claim 2, wherein the length of the return surface (23) is less than a third of the length of the combination surface (22).

12. A combination according to claim 3, wherein said curved surface (24) is formed and positioned so that distance between the peripheral notch (20) and the opening (7) is at least 1 mm.

13. A combination of a disc cylinder lock mechanism having a releasing condition and a key for operating the lock mechanism, the lock mechanism comprising:

a cylinder housing, an inner cylinder turnable inside the cylinder housing, a stack of discs inside the inner cylinders, wherein the discs define respective key openings which form a key channel for receiving the key and the stack of discs includes a plurality of locking discs each having a predetermined angular releasing position in the inner cylinder such that the lock mechanism is in its releasing condition when each locking disc is in its releasing position, and wherein each locking disc has a protrusion that extends toward the central part of the key opening and is defined between first and second adjacent edges that are substantially perpendicular to one another, and a guiding element that extends longitudinally over the stack of discs in the key channel, and the key has a combination surface for each locking disc and is formed to engage the guiding element when the key is inserted in the key channel for turning the guiding element continuously with the key when the key is turned in the lock, such that when the key is inserted in the key channel and is turned in a releasing direction, the combination surfaces engage the first edges of the respective locking discs to bring each locking disc to its respective predetermined angular releasing position, and when the key is turned in an opposite direction the guiding element engages the second edges of the respective locking discs to bring each locking disc to a key removal position.

14. A combination according to claim 13, wherein the lock mechanism further comprises a locking bar that has a locking position in which it prevents turning of the inner cylinder relative to the cylinder housing, each of the locking discs has a peripheral notch that is aligned with the peripheral notches of the other locking discs to form a groove when the locking discs are at their respective releasing positions in the inner cylinder, and when the locking discs are in their respective releasing positions, the locking bar is displaceable into the groove formed by the peripheral notches and allows turning of the inner cylinder, whereas when at least one of the locking discs is not in its releasing position, the locking bar is forced into its locking position.

15. A combination according to claim 13, wherein the second edge that defines the protrusion of a locking disc is substantially shorter than the first edge thereof.

16. A combination according to claim 13, wherein each of the locking discs has a peripheral notch and the key opening of each locking disc includes a curved surface extending from an outer end of the second edge at least as far as the angular position of the peripheral notch in the disc.

17. A combination according to claim 13, wherein the guiding element comprises two components extending symmetrically on opposite sides of the key channel in the axial direction thereof and each locking disc has, correspondingly, two separate protrusions each defined between first and second adjacent edges, and when the key is turned in said opposite direction the two components of the guiding element engage the second edges of the two protrusions respectively.

18. A combination according to claim 13, further comprising a profile disc at the key insertion end of the inner cylinder, and wherein the guiding element is supported by the profile disc.

19. A combination according to claim 18, wherein the stack of locking discs includes a 0-locking disc at the inner end of the inner cylinder and the key opening of the 0-locking disc has a different cross-sectional form from the key opening of the profile disc.

20. A key or a key blank for a combination according to claim 13, having a shaft of at least substantially rectangular cross-section and formed with at least one groove extending lengthwise over the shaft for receiving said guiding element, the shaft further having a first edge and, in association therewith, a side plane, starting from which combination surfaces determining the opening combination of the lock are cut as beveled surfaces at selected angular intervals from each other toward a second edge that is adjacent said first edge, said second edge being rounded.

21. A key or key blank according to claim 20, having two grooves located symmetrically on either side of the shaft and extending lengthwise over the shaft for receiving said guiding element.

22. A key or key blank according to claim 20, having two series of combination surfaces located symmetrically on opposite sides of a central axis of the shaft, the edges of the shaft that are adjacent to said two series of combination surfaces being rounded.

* * * * *